US009098029B2

(12) United States Patent
Ueno et al.

(10) Patent No.: US 9,098,029 B2
(45) Date of Patent: Aug. 4, 2015

(54) FIXING DEVICE INCLUDING A PLURALITY OF COILS, COIL DRIVERS, AND A DRIVE CIRCUIT

(71) Applicants: Tsuyoshi Ueno, Fukuoka (JP); Motokazu Hasegawa, Kanagawa (JP); Masataka Akaishi, Kanagawa (JP)

(72) Inventors: Tsuyoshi Ueno, Fukuoka (JP); Motokazu Hasegawa, Kanagawa (JP); Masataka Akaishi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 39 days.

(21) Appl. No.: 14/021,249

(22) Filed: Sep. 9, 2013

(65) Prior Publication Data

US 2014/0072320 A1 Mar. 13, 2014

(30) Foreign Application Priority Data

Sep. 12, 2012 (JP) ..... 2012-200911

(51) Int. Cl.
*G03G 15/20* (2006.01)

(52) U.S. Cl.
CPC ..... *G03G 15/2039* (2013.01); *G03G 15/2042* (2013.01)

(58) Field of Classification Search
CPC ..... G03G 15/2039; G03G 15/2042
USPC ..... 399/67, 122, 334, 335; 219/216
See application file for complete search history.

(56) References Cited

U.S. PATENT DOCUMENTS

| | | | | |
|---|---|---|---|---|
| 6,889,018 | B2 | 5/2005 | Kinouchi et al. | |
| 6,912,367 | B2 | 6/2005 | Miura | |
| 2004/0173603 | A1 * | 9/2004 | Kinouchi et al. | 219/661 |
| 2006/0062585 | A1 * | 3/2006 | Sone et al. | 399/69 |
| 2007/0084857 | A1 * | 4/2007 | Osaka | 219/660 |

FOREIGN PATENT DOCUMENTS

| | | | |
|---|---|---|---|
| JP | 03192687 | A * | 8/1991 |
| JP | 2000-206813 | | 7/2000 |
| JP | 2001-312178 | | 11/2001 |
| JP | 2001-319763 | | 11/2001 |
| JP | 4021707 | | 10/2007 |
| JP | 4047644 | | 11/2007 |

* cited by examiner

*Primary Examiner* — Francis Gray
(74) *Attorney, Agent, or Firm* — Oblon, McClelland, Maier & Neustadt, L.L.P.

(57) ABSTRACT

A fixing device which heats a heating object through induction heating by using a plurality of coils includes a plurality of coil drivers that drive the plurality of coils respectively, a drive circuit that controls ON/OFF states of a plurality of switching elements simultaneously to control the drive of the plurality of coil drivers, a control unit that controls a voltage supplied to each of the plurality of coils in accordance with the control of the ON/OFF states of the plurality of switching elements by the drive circuit, and a plurality of voltage control circuits that individually change the voltages supplied to the plurality of coils in accordance with the voltage control of the control unit.

9 Claims, 13 Drawing Sheets

FIXING DEVICE INCLUDING A PLURALITY OF COILS, COIL DRIVERS, AND A DRIVE CIRCUIT

BACKGROUND OF THE INVENTION

1. Field of the Invention

The present invention relates to a fixing device which heats a heating object through induction heating by using a plurality of induction heating coils.

2. Description of the Related Art

Generally, electrophotographic image forming devices according to the related art are provided with a fixing device which is adapted to fix toner to paper. Induction heating (IH) is known as one of various heating methods used in such a fixing device. Generally, induction heating (IH) is the process of heating an electrically conducting object by electromagnetic induction in which eddy currents are generated within the object and resistance leads to Joule heating of the object. In a power device (inverter) for induction heating, the amount of an alternating current (AC) that flows through an induction heating coil is controlled according to an operating frequency (ON time) of a switching element arranged in the inverter. Namely, it is known that the power control of the IH fixing system is carried out through the ON-time control of the switching element.

Moreover, in image forming devices according to the related art, recording sheets of various sizes (sheet widths) are used depending on the respective specifications of the image forming devices. For example, see Japanese Laid-Open Patent Publication No. 2000-206813, Japanese Laid-Open Patent Publication No. 2001-312178, and Japanese Patent No. 4,021,707. As disclosed in these publications, it is known that the image forming devices are provided with a plurality of induction heating coils which are arranged in parallel with the axial direction of a heating roller to have an arrangement distance suitable for the recording-sheet width, and the power supplied to the induction heating coils is controlled.

Further, in the image forming devices according to the related art, when supplying the power to each of the induction heating coils arranged in parallel with the axial direction of the heating roller, the electric energy generated in each of the induction heating coils is changed according to the temperature difference in the longitudinal direction of the heating roller. This means that there are two or more induction heating coils which are driven at different frequencies. In this case, interference noise may arise.

It is known that the timings of the power supply to the coils are to be changed in order to prevent the occurrence of the interference noise. However, if the power distribution ratios of the coils are maintained and the power supplying timings are changed to prevent the occurrence of the interference noise, the coils will be heated in a time-division manner with the changed supplying timings. In such a case, the fixing device according to the related art must have an extended time for reaching the fixing permissible temperature.

SUMMARY OF THE INVENTION

In one aspect, the present invention provides a fixing device which is capable of continuously supplying electric power to the coils without causing interference noise.

In an embodiment which solves or reduces one or more of the above-mentioned problems, the present invention provides a fixing device which heats a heating object through induction heating by using a plurality of coils, the fixing device including: a plurality of coil drivers that drive the plurality of coils respectively; a drive circuit that controls ON/OFF states of a plurality of switching elements simultaneously to control the drive of the plurality of coil drivers; a control unit that controls a voltage supplied to each of the plurality of coils in accordance with the control of the ON/OFF states of the plurality of switching elements by the drive circuit; and a plurality of voltage control circuits that individually change the voltages supplied to the plurality of coils in accordance with the voltage control of the control unit.

Other objects, features and advantages of the present invention will become more apparent from the following detailed description when read in conjunction with the accompanying drawings.

DETAILED DESCRIPTION OF THE PREFERRED EMBODIMENTS

A description will be given of embodiments of the invention with reference to the accompanying drawings.

In one embodiment, a fixing device includes a driver circuit configured to control ON/OFF states of switching elements at a same phase according to instructions from a control unit, and voltage control circuits configured to individually control voltages supplied to induction heating coils, and performs power control that increases or decreases the voltages supplied to the coils by using the voltage control circuits, so that the power supply to the coils is continuously performed until a fixing permissible temperature is reached without causing interference noise of the coils.

First Embodiment

Figure 1:
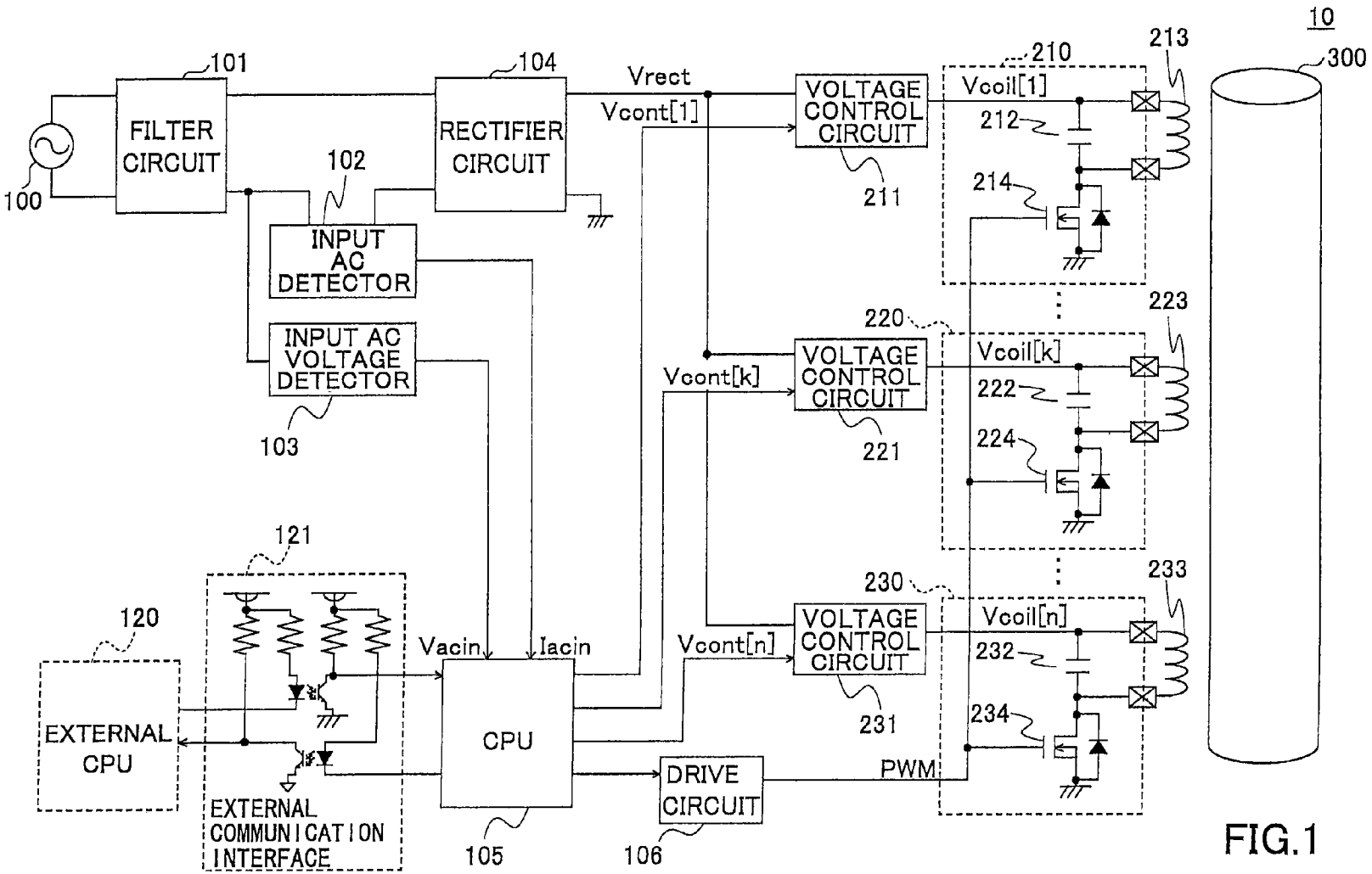
FIG. 1 is a diagram showing the configuration of a fixing device according to a first embodiment.

FIG. 1 is a diagram showing the configuration of a fixing device 10 of a first embodiment. As shown in FIG. 1, the fixing device 10 of this embodiment includes a power supply 100, a filter circuit 101, an input AC (alternating current) detector 102, an input AC voltage detector 103, a rectifier circuit 104, a CPU (central processing unit) 105, and a drive circuit 106. The fixing device 10 of this embodiment further includes voltage control circuits 211, 221, 231, coil drivers 210, 220, 230, and coils 213, 223, 233.

Upon receipt of a fixing request from an external CPU 120 via an external communication interface 121, the CPU 105 in the fixing device 10 of this embodiment controls the coil drivers 210, 220 and 230 to heat the coils 213, 223 and 233, respectively, so that a heating roller 300 is heated by the coils 213, 223 and 233. In this embodiment, an external communication IF (interface) 121 may be provided within the fixing device 10. Alternatively, the external communication IF 121 may be provided outside the fixing device 10. Generally, the external communication IF is insulated by a photo coupler or the like in order to prevent the internal electronic circuit thereof from being damaged. In this embodiment, the external CPU 120 may be equivalent to a main controller portion of an image forming device in which the fixing device 10 is installed. In this embodiment, the heating roller 300 may be provided within the fixing device 10. Alternatively, the heating roller 300 may be provided outside the fixing device 10.

The voltage control circuits 211, 221 and 231 of this embodiment supply voltage to the coil drivers 210, 220 and 230, so that the coils 213, 223 and 233 are driven. In this embodiment, the coil driver 210 includes a resonance capacitor 212 and a switching element 214. The coil driver 220 includes a resonance capacitor 222 and a switching element 224. The coil driver 230 includes a resonance capacitor 232 and a switching element 234.

In the coil drivers 210, 220 and 230 of this embodiment, the resonance capacitors 212, 222 and 232 are connected in parallel with the coils 213, 223 and 233, respectively, so that the resonant circuit is formed in each of the coil drivers 210, 220 and 230. The switching elements 214, 224 and 234 are connected in series with the coils 213, 223 and 233, respectively, so that the driving of the corresponding resonant circuit is controlled by each of the switching elements 214, 224 and 234.

For example, each of the switching elements 214, 224 and 234 of this embodiment is made of any of a power MOSFET (metal-oxide semiconductor field-effect transistor), an IGBT (insulated gate bipolar transistor), etc. A PWM (pulse width modulation) signal (which will be described later) output from the drive circuit 106 is supplied to each gate of the switching elements 214, 224 and 234. The drive circuit 106 is controlled by the CPU 105 and controls ON/OFF states of the switching elements 214, 224 and 234 according to the instructions from the CPU 105.

In the fixing device 10 of this embodiment, a source voltage output from the power supply 100 is filtered by the filter circuit 101, and a voltage Vrect rectified by the rectifier circuit 104 is supplied to each of the voltage control circuits 211, 221 and 231. In the fixing device 10 of this embodiment, control signals Vcont output from the CPU 105 are supplied to the voltage control circuits 211, 221 and 231.

Next, the filter circuit 101, the input AC detector 102, the input AC voltage detector 103, and the rectifier circuit 104 of this embodiment will be described with reference to FIG. 2.

Figure 2:
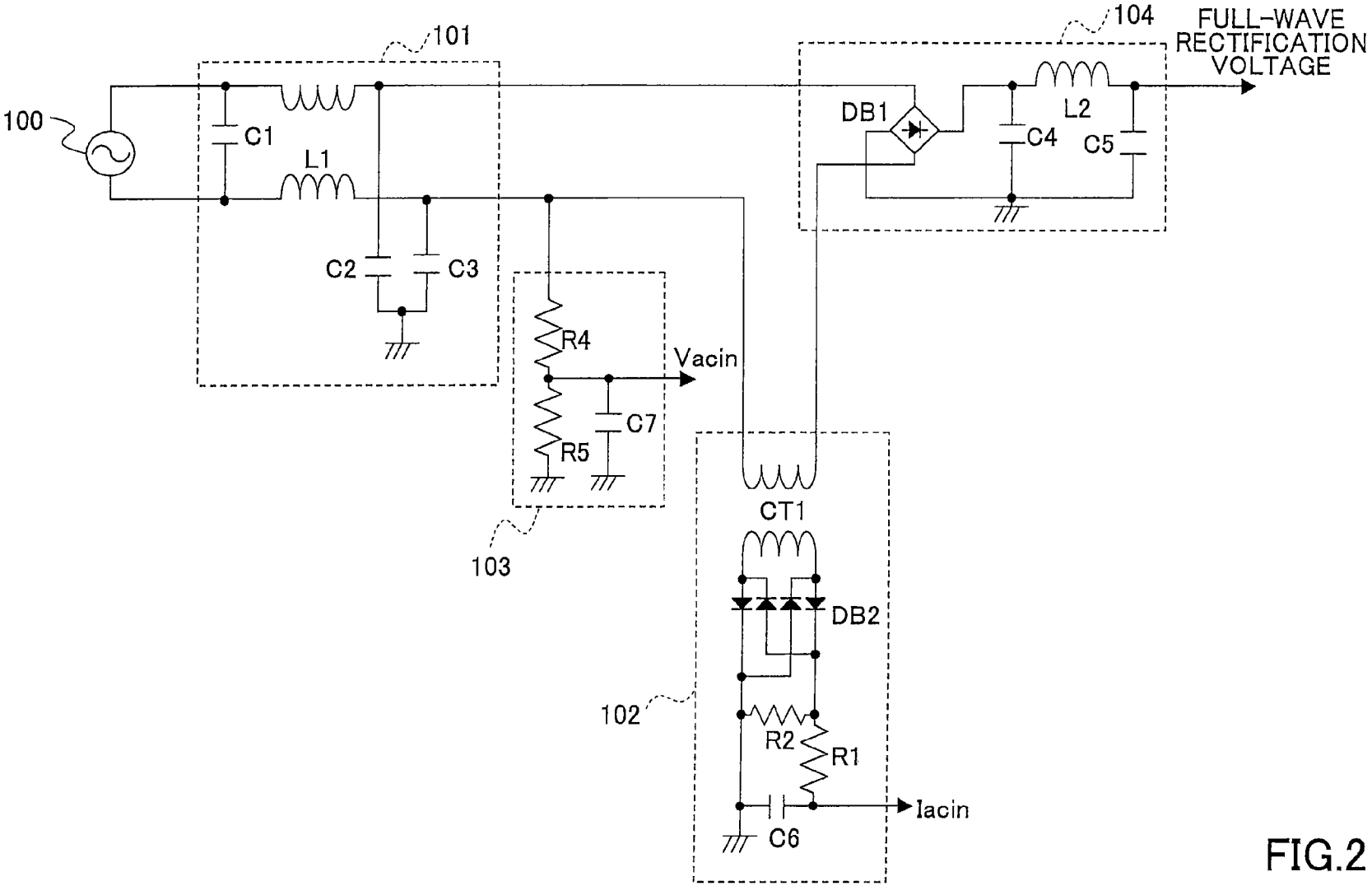
FIG. 2 is a diagram showing a circuit configuration of the fixing device of the first embodiment.

FIG. 2 is a diagram showing a circuit configuration of the fixing device of the first embodiment. As shown in FIG. 2, the filter circuit 101 of this embodiment includes capacitors C1, C2, C3, and a coil L1, and functions to reduce the influences on the power supply 100 due to the switching noise produced inside the fixing device 10.

The input AC detector 102 of this embodiment includes a current transformer CT1 connected to one of the output terminals of the filter circuit 101, a diode bridge DB2, resistors R1 and R2, and a capacitor C6. The input AC detector 102 of this embodiment outputs an input AC value Iacin.

The input AC voltage detector 103 of this embodiment includes resistors R4, R5 and a capacitor C7. The input AC voltage detector 103 outputs an input AC voltage value Vacin.

The rectifier circuit 104 of this embodiment includes a diode bridge DB1, a coil L2 and capacitors C4 and C5, and carries out full-wave rectification of the input AC voltage using the diode bridge DB1 and the LC filter formed by the coil L2 and the capacitors C4 and C5.

The input AC current value Iacin and the input AC voltage value Vacin are supplied to the CPU 105, and the CPU 105 controls the drive of the fixing device 10. Based on the input AC current value Iacin and the input AC voltage value Vacin, the CPU 105 controls the drive of the fixing device 10 so that the charge power of the fixing device 10 becomes a desired value.

Next, the heating roller 300 of this embodiment will be described with reference to FIG. 3.

Figure 3:
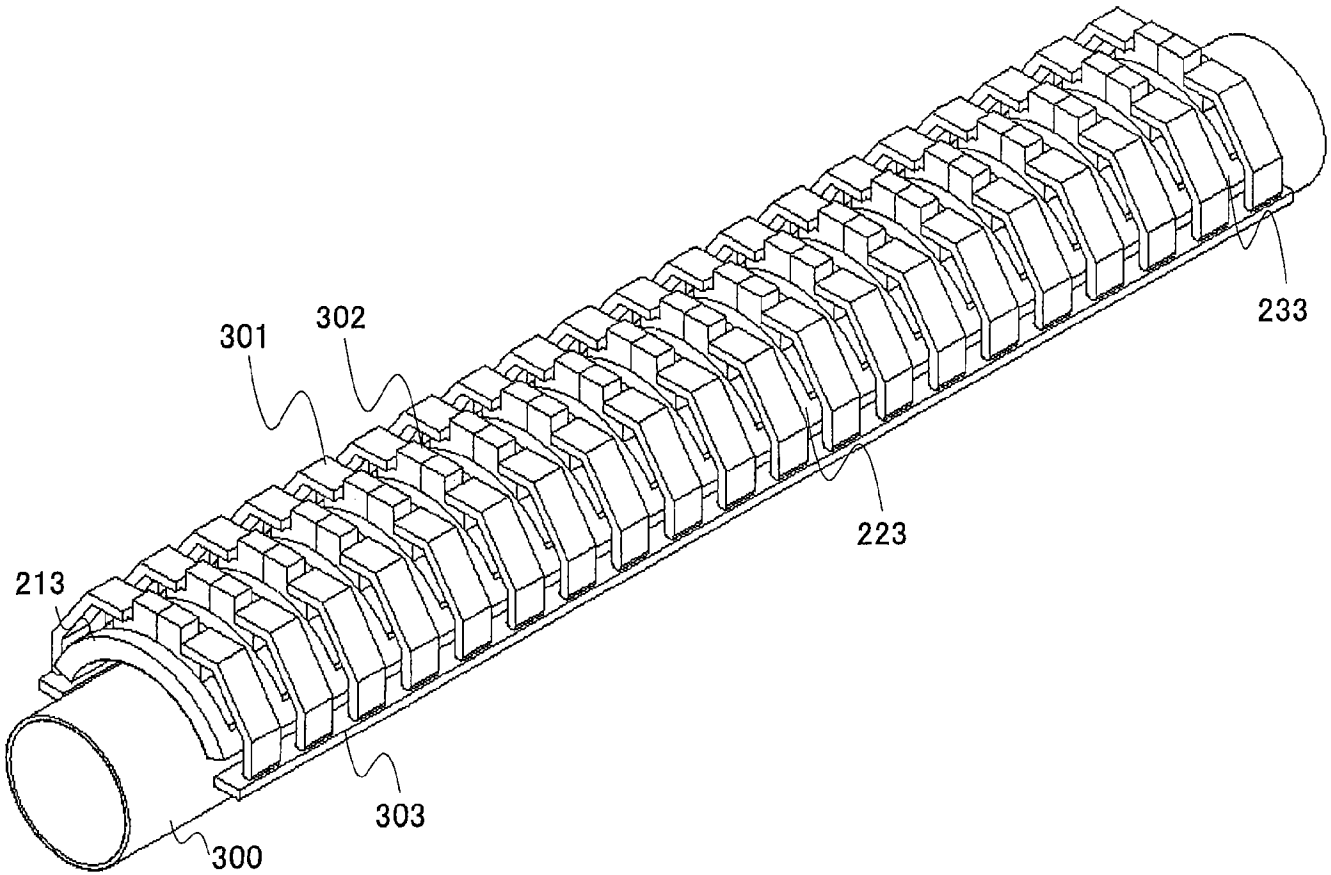
FIG. 3 is a perspective view of a heating roller in the fixing device of the first embodiment.

FIG. 3 is a perspective view of a heating roller 300 in the fixing device of this embodiment. As shown in FIG. 3, in the heating roller 300 of this embodiment, a plurality of coils is arranged adjacent to the heating roller 300 in the longitudinal direction of the heating roller. Specifically, among the plurality of coils of this embodiment, the 1st coil 213, the k-th coil 223 and the n-th coil 233 ($2 \leq k \leq n$, $n \geq 2$) are arranged along the outer peripheral surface of the heating roller 300.

Around each of the plurality of coils of this embodiment, arch cores 301, center cores 302 and side cores 303 are arranged as electrically-insulating members. These cores 301-303 are made of a ferrite or a similar magnetic material. A half portion of the heating roller 300 is surrounded by the cores 301-303 of the plurality of coils such that magnetic fluxes on one side of the heating roller 300 may not leak to the opposite side of the heating roller 300. The arch cores 301, the center cores 302 and the side cores 303 are disposed to face toward each of the plurality of coils including the coils 213, 223 and 233 by using a non-illustrated fixing jig mounted on the heating roller 300.

Next, the waveforms of a coil current Icoil supplied to the coil 213 and an end-to-end voltage Vds of the switching element 214 during a voltage resonance operation will be described with reference to FIGS. 4 to 7B.

Figure 4:
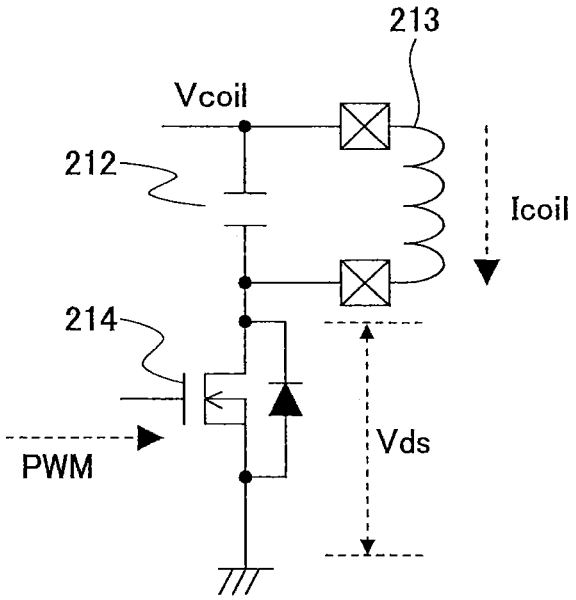
FIG. 4 is a diagram showing a coil driver in the fixing device of the first embodiment.

FIG. 4 is a diagram showing the coil driver 210 in the fixing device of the first embodiment. The coil driver 210 of this embodiment is operable to conduct the alternating current Icoil to the coil 213 for induction heating. In this embodiment, the resonance capacitor 212 is connected in parallel with the coil 213, and the switching element 214 is connected in series with the coil 213. A coil voltage Vcoil is supplied to the coil 213. The PWM (pulse width modulation) signal which is output from the drive circuit 106 to drive the switching element 214 is supplied to the gate of the switching element 214.

Figure 5:
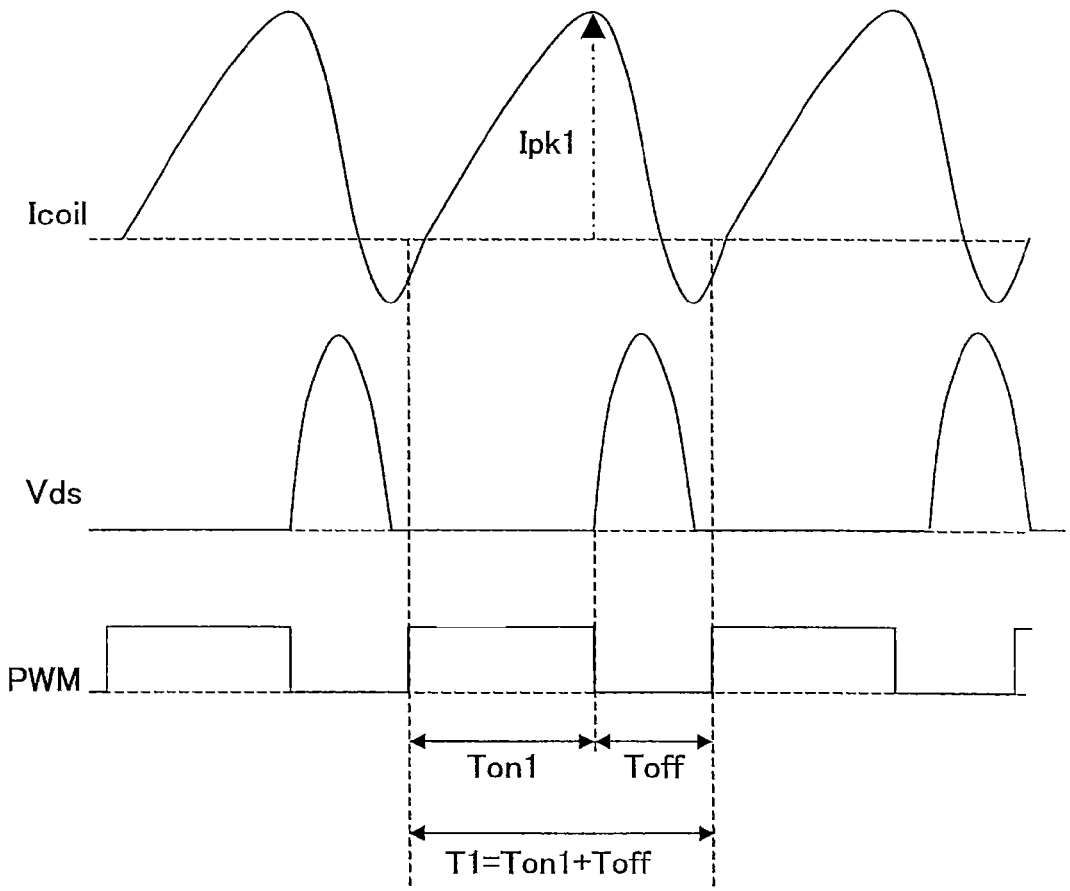
FIG. 5 is a diagram showing the waveforms of a coil current, a switching element end-to-end voltage and a PWM signal when the switching element is turned on and off by the PWM signal.

FIG. 5 is a diagram showing the waveforms of the coil current Icoil, the switching element end-to-end voltage Vds and the PWM signal when the switching element 214 is turned on and off by the PWM signal. As shown in FIG. 5, when the PWM signal is at a high level (H level), the switching element 214 is turned on and the coil current Icoil starts increasing. When the PWM signal is switched from the H level to a low level (L level), the switching element 214 is turned off and the coil current Icoil starts decreasing.

On the other hand, when the coil current Icoil starts decreasing, the switching element end-to-end voltage Vds is increased in a manner similar to a sinusoidal waveform signal because the resonance of the resonance capacitor 212 takes place at this time. In the example of FIG. 5, when the internal diode of the switching element 214 is turned on because of the resonance of the capacitor, the switching element end-to-end voltage is reset to zero (Vds=0). The PWM signal is generated to change from the L level to the H level in sync with this timing, so that the switching element 214 may be turned on while the switching element end-to-end voltage is equal to zero (Vds=0).

In this embodiment, an ON time Ton1 of the PWM signal for which the switching element 214 is in an ON state is adjusted to adjust the coil current Icoil (or the peak coil current value Ipk1). Thus, the charge power is controlled to control the heating value of the heating roller 300. An OFF time Toff of the PWM signal for which the switching element 214 is in an OFF state may be determined by the coil 213 and the resonance capacitor 212.

Figure 6:
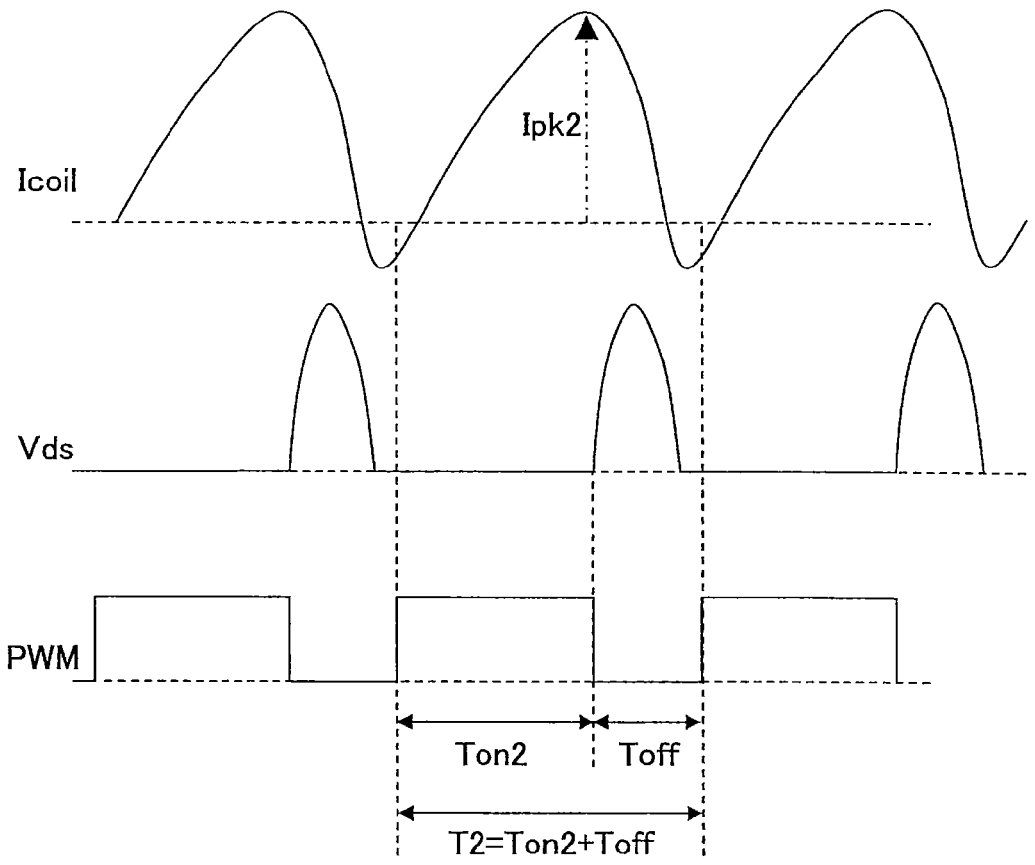
FIG. 6 is a diagram showing the waveforms of the coil current, the switching element end-to-end voltage and a PWM signal when the switching element is turned on and off by the PWM signal having an ON time Ton2 less than an ON time Ton1.

FIG. 6 is a diagram showing the waveforms of the coil current, the switching element end-to-end voltage and a PWM signal when the switching element is turned on and off by the PWM signal having an ON time Ton2 less than the ON time Ton1.

In the example of FIG. 6, the ON time Ton2 is less than the ON time Ton1 and a peak coil current value Ipk2 of the coil current Icoil is lowered from that in the example of FIG. 5. Shortening the ON time of the switching element 214 enables the drive frequency fsw of the switching element 214 to be increased.

If the drive frequency fsw of the switching element 214 is increased, the charge power to the coil 213 Pin is decreased. If the drive frequency fsw of the switching element 214 is decreased, the charge power Pin to the coil 213 is increased. The charge power Pin is the electric power supplied to the coil 213, and the charge power Pin is determined by the product of the coil current Icoil and the coil voltage Vcoil. The drive frequency fsw is the reciprocal of the period T (fsw=1/T).

Figure 7B:
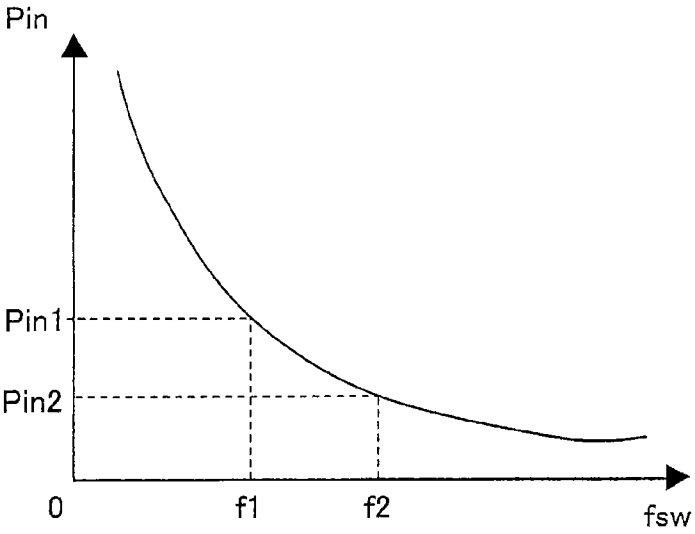
FIG. 7A and FIG. 7B are diagrams showing the relationship between a drive frequency and a peak coil current value when the drive frequency is varied and the relationship between the drive frequency and a charge power when the drive frequency is varied.
Figure 7A:
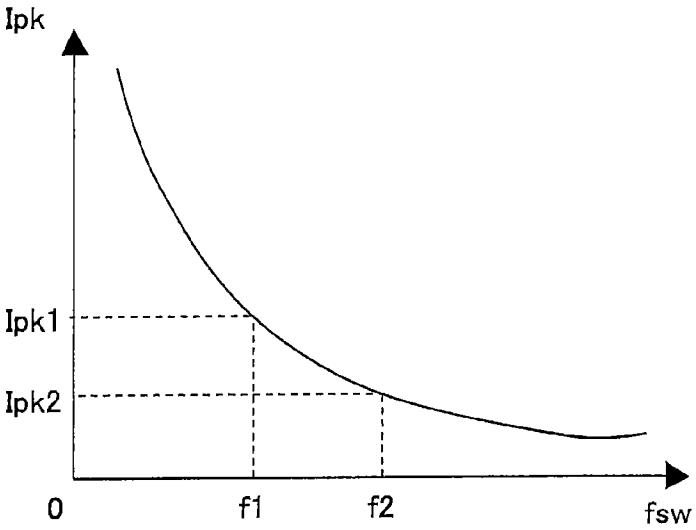

If the drive frequency fws in the case of FIG. 5 is expressed by f1=1/(Ton1+Toff) and the drive frequency fsw in the case of FIG. 6 is expressed by f2=1/(Ton2+Toff), the relationship between the drive frequency fsw and the peak coil current value Ipk and the relationship between the drive frequency fsw and the charge power Pin are as shown in FIG. 7A and FIG. 7B, respectively.

FIG. 7A and FIG. 7B are diagrams showing the relationship between the drive frequency fsw and the peak coil current value Ipk when the drive frequency fsw is varied and the relationship between the drive frequency fsw and the charge power Pin when the drive frequency fsw is varied.

As previously described, if the power control is performed according to the drive frequency while different coils of the plurality of coils provided in the fixing device are simultaneously driven, interference noise may arise due to the difference in the drive frequency between the different coils. When the power control is performed according to the drive frequency, the ON time of the switching element 214 may be changed and the coil current Icoil (the peak coil current value Ipk1) may be increased or decreased.

If the different coils among the plurality of coils are controlled driven in a time-division manner so as to prevent the occurrence of the interference noise, the coils cannot be heated continuously until the fixing-permissible temperature of the coils is reached, and the time for reaching the fixing-permissible temperature will be increased.

The fixing device 10 of this embodiment is adapted to eliminate the above problem. In the fixing device 10 of this embodiment, "n" resonance capacitors are connected in parallel with "n" coils, and "n" switching elements are connected in series with the "n" coils, respectively. Further, the fixing device 10 of this embodiment includes "n" voltage control circuits each of which is configured to supply the coil voltage Vcoil[k] ($1<k\leq n$, $n\geq 2$) to the corresponding one of the n coils.

Specifically, in the fixing device 10 of this embodiment, the coil 213 is considered as the first coil among the n coils, the coil 223 is considered as the k-th coil, and the coil 233 is considered as the n-th coil. The fixing device 10 of this embodiment is configured so that the voltage control circuit 221 supplies the coil voltage Vcoil[1] to the first coil 213, the voltage control circuit 221 supplies the coil voltage Vcoil[k] to the k-th coil 223, and the voltage control circuit 231 supplies the coil voltage Vcoil[n] to the n-th coil 233. In this embodiment, the rectified voltage Vrect output from the rectifier circuit 104 is supplied to each of the voltage control circuits 211, 221 and 231. A coil voltage control signal Vcont [k] ($1<k\leq n$, $n\geq 2$) which is generated to control individually the coil voltage Vcoil[k] ($1<k\leq n$, $n\geq 2$) is supplied from the CPU 105 to each of the voltage control circuits 211, 221 and 231.

In the fixing device 10 of this embodiment, in order to make the drive frequencies of the coils 213, 223 and 233 in agreement, the PWM signal from the drive circuit 106 is supplied to each of the gates of the switching elements 214, 224 and 234.

In the fixing device 10 of this embodiment, the switching elements 214, 224 and 234 are turned on and off simultaneously, and the coil voltage Vcoil[k] to be supplied to the coils 213, 223 and 233 is individually controlled by the corresponding one of the voltage control circuits 211, 221 and 231. Therefore, by the foregoing configuration of this embodiment, the occurrence of the interference noise due to the difference in the drive frequency between the switching elements is prevented and the electric power supplied to each coil can be controlled.

Next, the relationship between the PWM signal and the coil voltage Vcoil[k] when the drive frequencies of the coils 213, 223 and 233 are made to be in agreement and the coil voltage Vcoil[k] is controlled by the corresponding one of the voltage control circuits 211, 221 and 231 will be described with reference to FIGS. 8, 9A and 9B.

Figure 8:
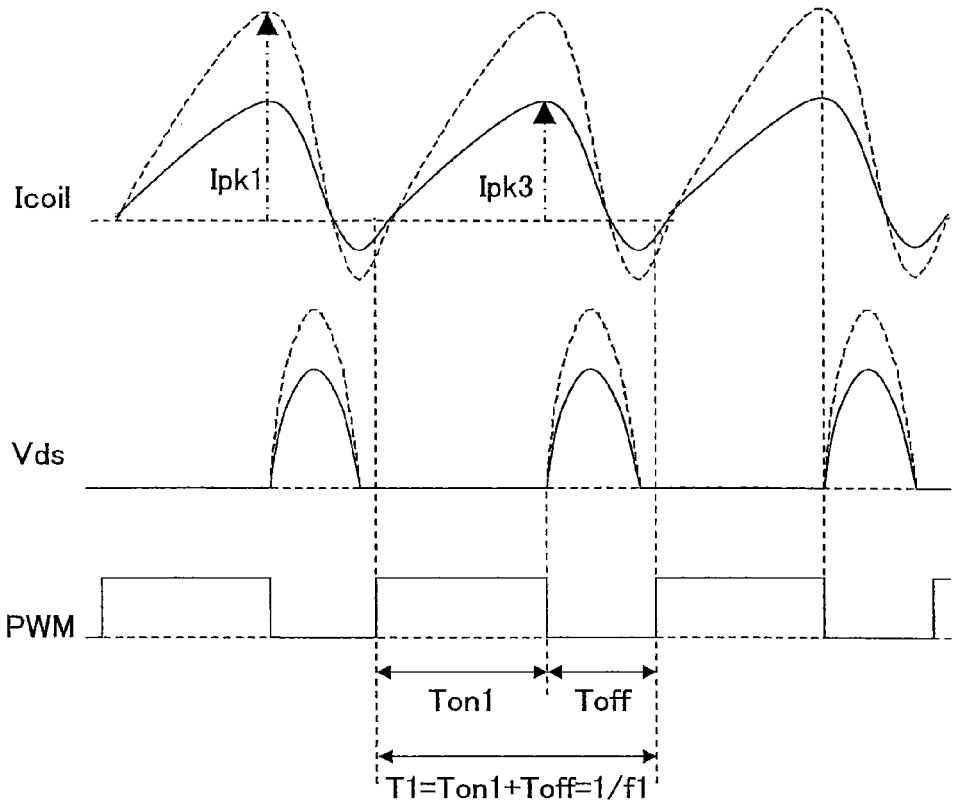
FIG. 8 is a diagram showing the waveforms of the coil current, the switching element end-to-end voltage and the PWM signal when the coil voltages of two adjacent coils of the plurality of coils differ.

FIG. 8 is a diagram showing the waveforms of the coil current, the switching element end-to-end voltage and the PWM signal when the coil voltages of two adjacent coils of the plurality of coils differ.

In the example of FIG. 8, it is assumed that the coil voltage Vcoil[k] of the k-th coil of the "n" coils is equal to V1 (Vcoil[k]=V1) and the coil voltage Vcoil[k+1] of the (k+1)-th coil of the "n" coils is equal to V3 (Vcoil[k+1]=V3, V1>V3). The peak coil current value Ipk of the coil current Icoil[k] (the waveform of which is indicated by the dotted line in FIG. 8) is set to Ipk1 for the k-th coil, and the peak coil current value Ipk of the coil current Icoil[k+l] (the waveform of which is indicated by the solid line in FIG. 8) is set to Ipk3 for the (k+1)-th coil.

As described above, in the example of FIG. 8, the drive frequencies of the two adjacent coils are made to be in agreement (which are equal to the drive frequency fsw=1/(Ton1+Toff)), and there is no frequency difference between the drive frequencies of the coils. In the absence of the drive frequency difference, no interference noise of the coils is produced.

Figure 9A:
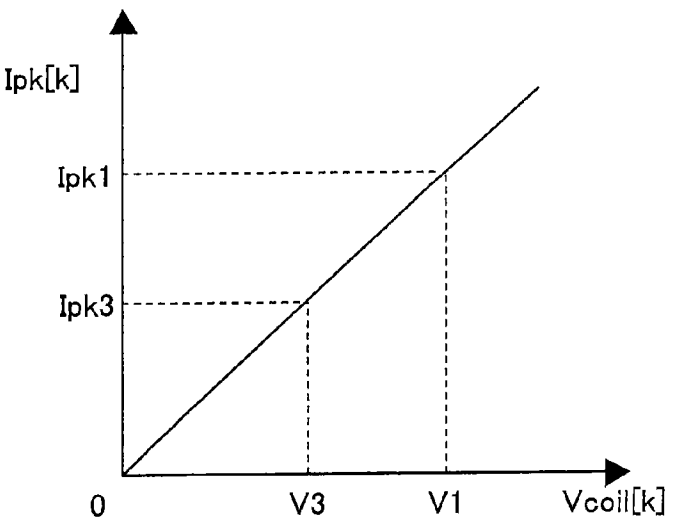
FIG. 9A and FIG. 9B are diagrams showing the relationship between the coil voltage and the peak coil current value when the drive frequencies of the coils are in agreement and the relationship between the coil voltage and the charge power when the drive frequencies of the coils are in agreement.
Figure 9B:
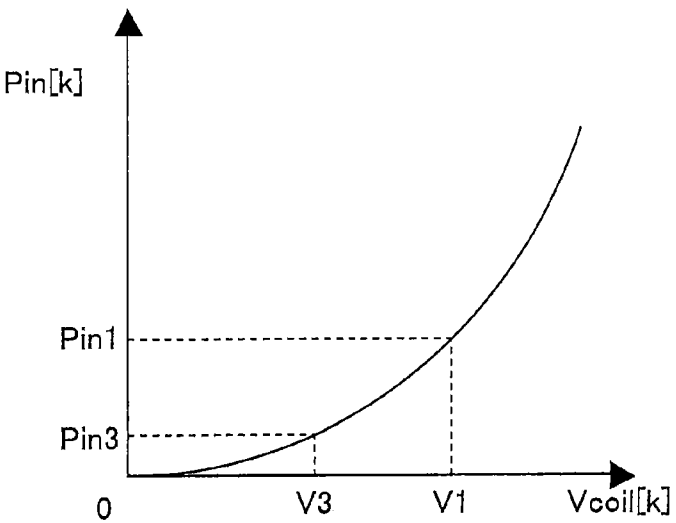

FIG. 9A shows the relationship between the coil voltage Vcoil and the peak coil current value Ipk when the drive frequencies of the coils are in agreement and FIG. 9B shows the relationship between the coil voltage Vcoil and the charge power Pin when the drive frequencies of the coils are in agreement.

In this embodiment, the peak coil current value Ipk of the coil current Icoil[k] can be controlled by controlling the coil voltage Vcoil[k] so as to meet the relationship shown in FIG. 9A, and the charge power Pin can be continuously supplied to the coil as shown in FIG. 9B.

Specifically, the CPU 105 in the fixing device 10 of this embodiment controls the drive circuit 106 to output, to each of the gates of the switching elements 214, 224 and 234, the PWM signal which turns on and off the switching elements 214, 224 and 234 simultaneously. By this control, the drive frequencies of the switching elements 214, 224 and 234 are made to be in agreement and the occurrence of the interference noise of the coils 213, 223 and 233 can be prevented.

Further, in the fixing device 10 of this embodiment, the peak coil current value Ipk can be controlled by controlling the coil voltage Vcoil as shown in FIG. 9A. Specifically, the CPU 105 in this embodiment is configured to control the voltage control circuits 211, 221 and 231 to supply the coil voltage Vcoil[k] to the coils 213, 223 and 233, respectively, so that the power supplied to the coils 213, 223 and 233 may be controlled or adjusted.

For example, when it is desired to lower the power generated in the coil 213, the CPU 105 may control the voltage control circuit 211 to output a lowered coil voltage Vcoil[1] to the coil 213. On the other hand, when it is desired to increase the power generated in the coil 213, the CPU 105 may control the voltage control circuit 211 to output an increased coil voltage Vcoil[1] to the coil 213. Thus, in the fixing device 10 of this embodiment, when controlling the power supplied to the coil, it is not necessary to change the drive frequency of the switching element associated with the coil. In the fixing device 10 of this embodiment, it is not necessary to perform the heating of the coils in a time-division manner by changing the power supplying timing. Therefore, in the fixing device 10 of this embodiment, the power can be continuously supplied to the coils without causing the occurrence of the interference noise.

Next, the voltage control circuits 211, 221 and 231 of this embodiment will be described with reference to FIG. 10.

In this embodiment, the voltage control circuits 211, 221 and 231 are configured to have the same structure, and the voltage control circuit 211 will be described as a representative voltage control circuit in the fixing device of this embodiment with reference to FIG. 10.

Figure 10:
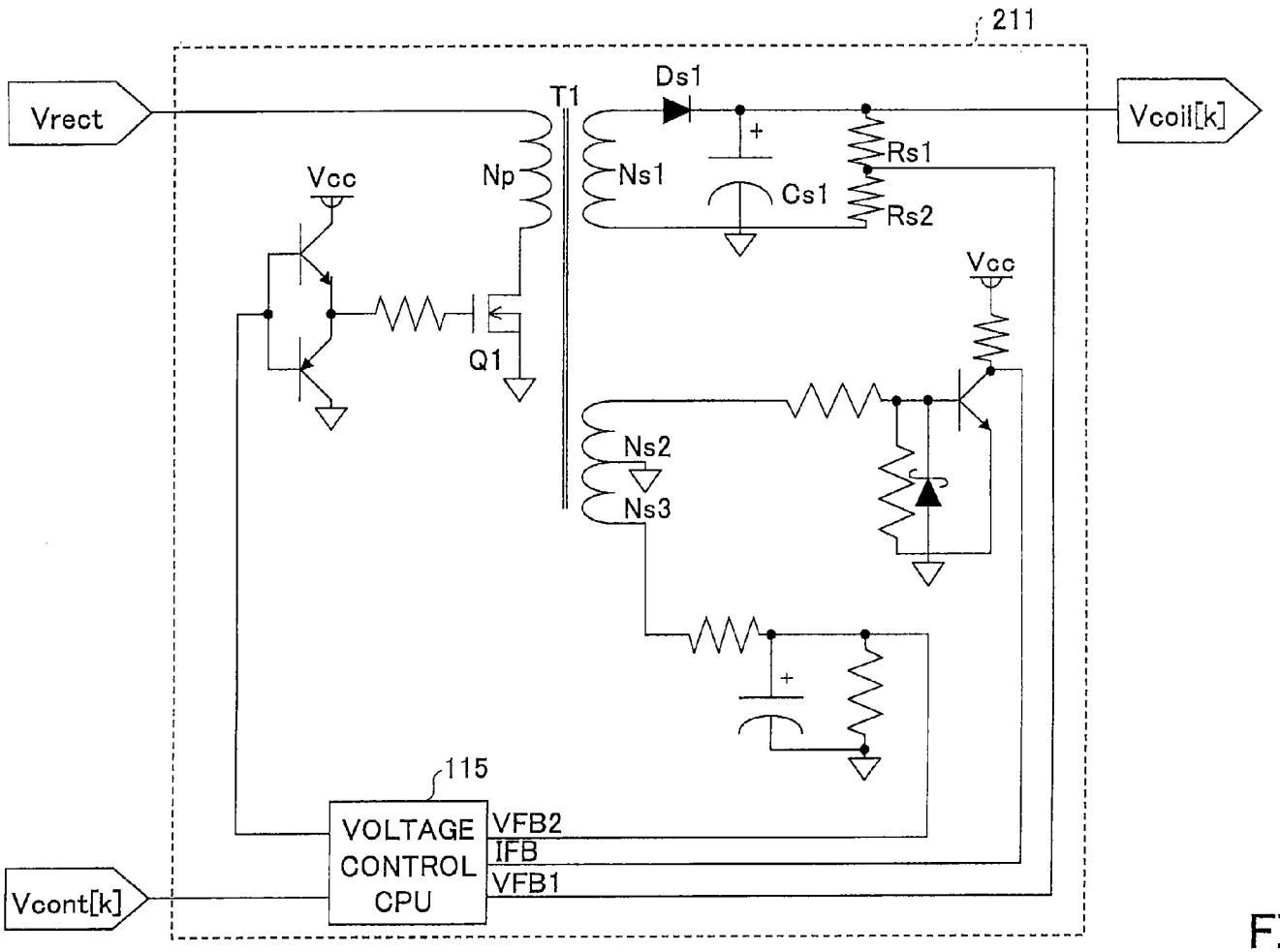
FIG. 10 is a diagram showing the configuration of a voltage control circuit in the fixing device of the first embodiment.

FIG. 10 is a diagram showing the configuration of the voltage control circuit 211 in the fixing device of this embodiment. As shown in FIG. 10, the voltage control circuit 211 of this embodiment is formed by implementing the principle of a flyback converter.

The voltage control circuit 211 of this embodiment includes a transformer T1, a voltage control CPU 115, a transistor Q1, a diode Ds1, a capacitor Cs1, and resistors Rs1 and Rs2.

In the voltage control circuit 211 of this embodiment, the rectified voltage Vrect which is produced by the full-wave rectification of the input AC voltage by the rectifier circuit 104 is supplied to the transformer T1. The transformer T1 is constructed to include a primary winding Np and a plurality of secondary windings Ns1, Ns2 and Ns3. In the voltage control circuit 211, the ON/OFF states of the transistor Q1 are controlled under the control of the voltage control CPU 115.

In this embodiment, current flows through the primary winding Np of the transformer T1 by turning the transistor Q1 ON and OFF. When the current flows through the primary winding Np, the corresponding voltage and current are also produced in each of the secondary windings Ns1, Ns2 and Ns3 of the transformer T1 according to the respective winding ratios. The voltage produced in the secondary winding Ns1 is rectified by the diode Ds1 and smoothed by the capacitor Cs1. In the voltage control circuit 211 of this embodiment, the smoothed voltage from the capacitor Cs1 is supplied to the coil 213 as the coil voltage Vcoil[k].

In the voltage control circuit 211 of this embodiment, a reduced voltage is produced through the voltage division of the coil voltage Vcoil[k] using the resistors Rs1 and Rs2, and the reduced voltage supplied to the voltage control CPU 115 as an output voltage monitoring signal VFB1.

In the voltage control circuit 211 of this embodiment, the secondary winding Ns2 is used to monitor the current flowing through the transformer T1 and supplies a timing signal IFB to the voltage control CPU 115 at a timing the current is reset to 0. In the voltage control circuit 211 of this embodiment, the secondary winding Ns3 is used to decrease or increase the voltage Vrect by a winding ratio of the winding Ns3 to the winding Np1.

In the voltage control circuit 211 of this embodiment, the voltage generated in the secondary winding Ns3 is smoothed by a resistor and a capacitor, and the smoothed voltage is supplied to the voltage control CPU 115 as an input voltage monitoring signal VFB2, in order to monitor the input voltage Vrect.

In the voltage control circuit 211 of this embodiment, the voltage control CPU 115 controls the timing of the switching ON/OFF of the transistor Q1 in response to the timing signal IFB, the output voltage monitoring signal VFB1 and the input voltage monitoring signal VFB1, so that the coil voltage Vcoil[k] as the output voltage of the voltage control circuit 211 may be maintained at a constant value.

In the voltage control circuit 211 of this embodiment, the control signal Vcont[k] from the CPU 105 is supplied to the voltage control CPU 115, and the voltage control CPU 115 controls the ON time of the transistor Q1 according to the received control signal Vcont[k], so that the coil voltage Vcoil[k] may be changed.

For example, the voltage control CPU 115 of this embodiment may be implemented by any of a microcomputer, a timer IC (integrated circuit) in which a voltage comparator circuit and a pulse control circuit are incorporated, and an analog circuit in which a voltage comparator circuit and a pulse control circuit are individually constructed. The control signal Vcont[k] output from the CPU 105 may be implemented by an analog voltage which is generated by using an ADC (analog-to-digital converter) carried in the CPU 105. Alternatively, the control signal Vcont[k] may be implemented by using a serial communication interface.

Figure 11A:
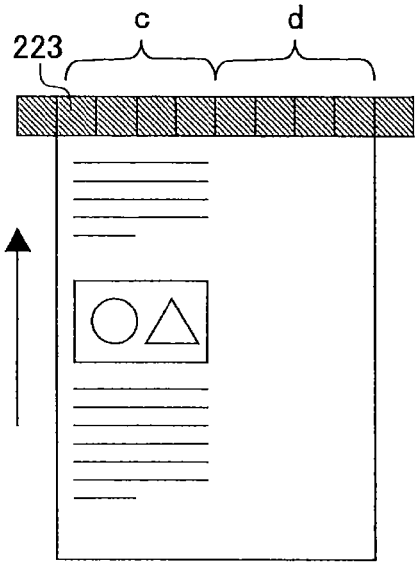
FIG. 11A and FIG. 11B are diagrams for explaining a control operation in which the plurality of coils are driven based on image information.
Figure 11B:
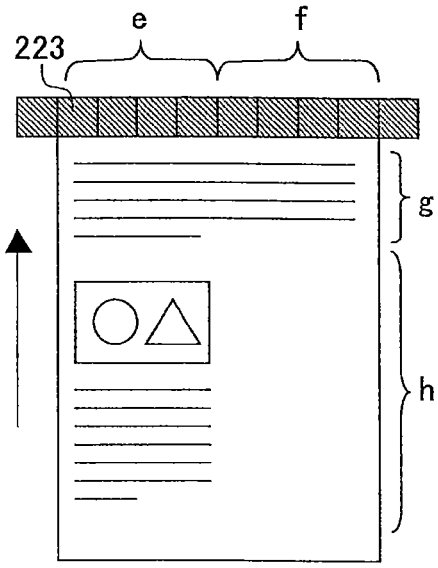

Next, a control operation in which the plurality of coils is driven based on image information for forming an image on a recording sheet will be described with reference to FIG. 11A and FIG. 11B. FIG. 11A and FIG. 11B are diagrams for explaining the control operation in which the plurality of coils is driven based on the image information. FIG. 11A shows an example of the image information in which an image area c and an image area d are arrayed on a recording sheet in a main scanning direction. In the example of FIG. 11A, the plurality of coils (indicated by the shading) is arranged in a direction perpendicular to a transporting direction of the recording sheet, and the coil 223 is used as the k-th coil at a location corresponding to the left-hand end of the recording sheet.

In the example of FIG. 11A, the toner to be fixed to the sheet is present in the image area c and it is necessary to drive the coils in the image area c so as to heat the corresponding part of the heating roller 300. However, the toner to be fixed to the sheet is not present in the image area d and it is not necessary to drive the coils in the image area d so as to heat the corresponding part of the heating roller 300.

Similarly, FIG. 11B shows an example of the image information in which an image area e and an image area f are arrayed on a recording sheet in a main scanning direction, and a transport area g and a transport area h are arrayed in a sub-scanning direction (i.e., a transporting direction of the recording sheet).

In the example of FIG. 11B, the toner to be fixed to the sheet is present in the image areas e and f corresponding to the transport area g, and it is necessary to drive the coils in these areas so as to heat the corresponding part of the heating roller 300. On the other hand, however, the toner to be fixed to the sheet is present in the image area e corresponding to the transport area h, but it is not present in the image area f corresponding to the transport area h. Therefore, in the example of FIG. 11B, it is necessary to drive only the coils in the image area e so as to heat the corresponding part of the heating roller 300.

In the example of FIG. 11A, only the k-th to the (k+3)-th coils may be driven and the heating of the corresponding part of the heating roller 300 for the no-toner image area may be stopped, so that the power dissipation may be reduced. Alternatively, the power supplied to the coils in the no-toner image area may be reduced, so that the power dissipation may be reduced.

In this embodiment, when the power supplied to the coils is to be stopped or reduced, the coil voltage Vcoil[k] may be reset to 0 or the coil voltage Vcoil[k] may be reduced as shown in FIG. 9A and FIG. 9B.

Figure 12A:
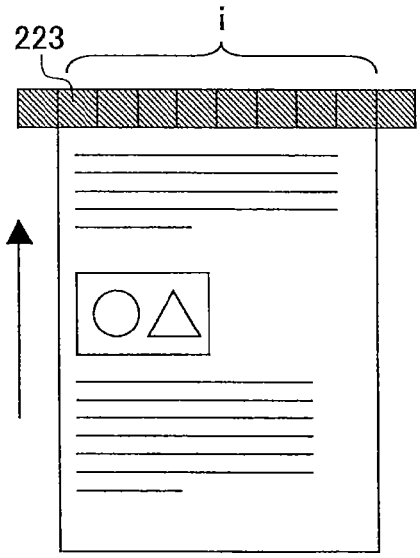
FIG. 12A and FIG. 12B are diagrams for explaining a control operation in which the plurality of coils are driven based on a sheet size.
Figure 12B:
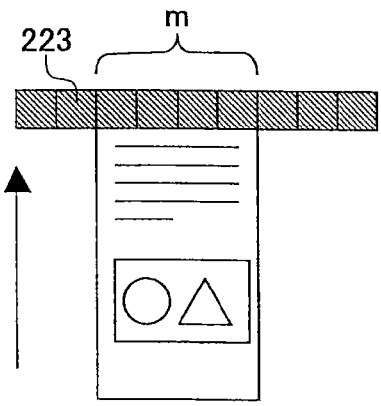

Next, a control operation in which the plurality of coils is driven based on a sheet size will be described with reference to FIG. 12A and FIG. 12B. FIG. 12A and FIG. 12B are diagrams for explaining the control operation in which the plurality of coils is driven based on a sheet size. FIG. 12A shows an example of the image information in which an image area i is arrayed on a recording sheet from a head-end location in a transporting direction of the recording sheet. In the example of FIG. 12A, the plurality of coils (indicated by the shading) is arranged in a direction perpendicular to the transporting direction of the recording sheet, and the coil 223 is used as the k-th coil at a location corresponding to the left-hand end of the recording sheet.

FIG. 12B shows an example of the image information in which an image area m is arrayed on a recording sheet having a sheet width less than that in the example of FIG. 12A. While it is necessary to drive the k-th to the (k+7)-th coils in the example of FIG. 12A, driving the (k+1)-th to the (k+3)-th coils in the image area m may be adequate for the example of FIG. 12B because the sheet width shown in FIG. 12B is less than that shown in FIG. 12A.

Therefore, in the fixing device of this embodiment, the heating of the corresponding part of the heating roller 300 for the no-toner image area may be stopped, so that the power dissipation may be reduced. Alternatively, the power supplied to the coils in the no-toner image area may be reduced, so that the power dissipation may be reduced.

In this embodiment, when the power supplied to the coils is to be stopped or reduced, the coil voltage Vcoil[k] may be reset to 0 or the coil voltage Vcoil[k] may be reduced as shown in FIG. 9A or FIG. 9B.

Second Embodiment

Figure 13:
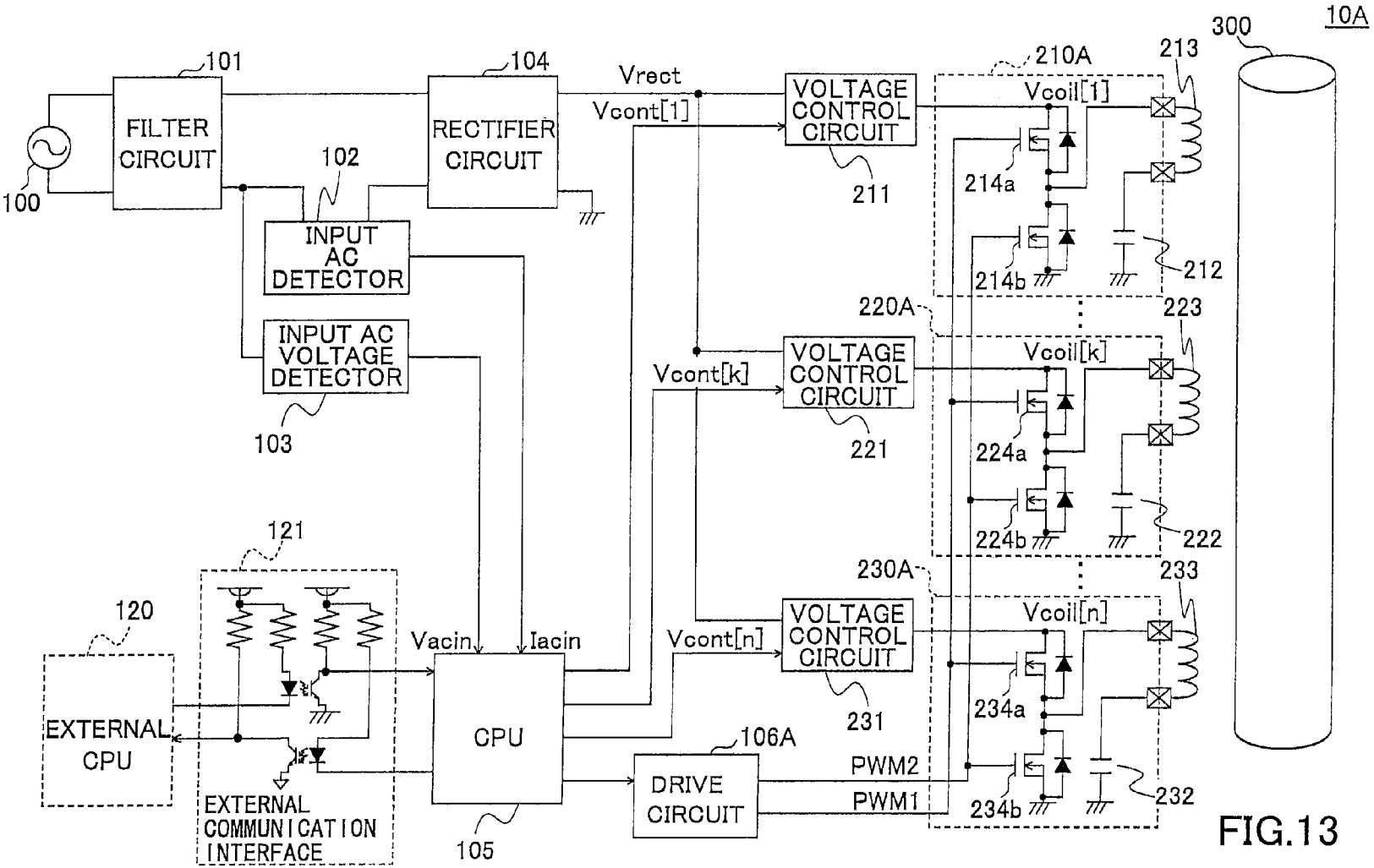
FIG. 13 is a diagram showing the configuration of a fixing device according to a second embodiment.
Figure 14:
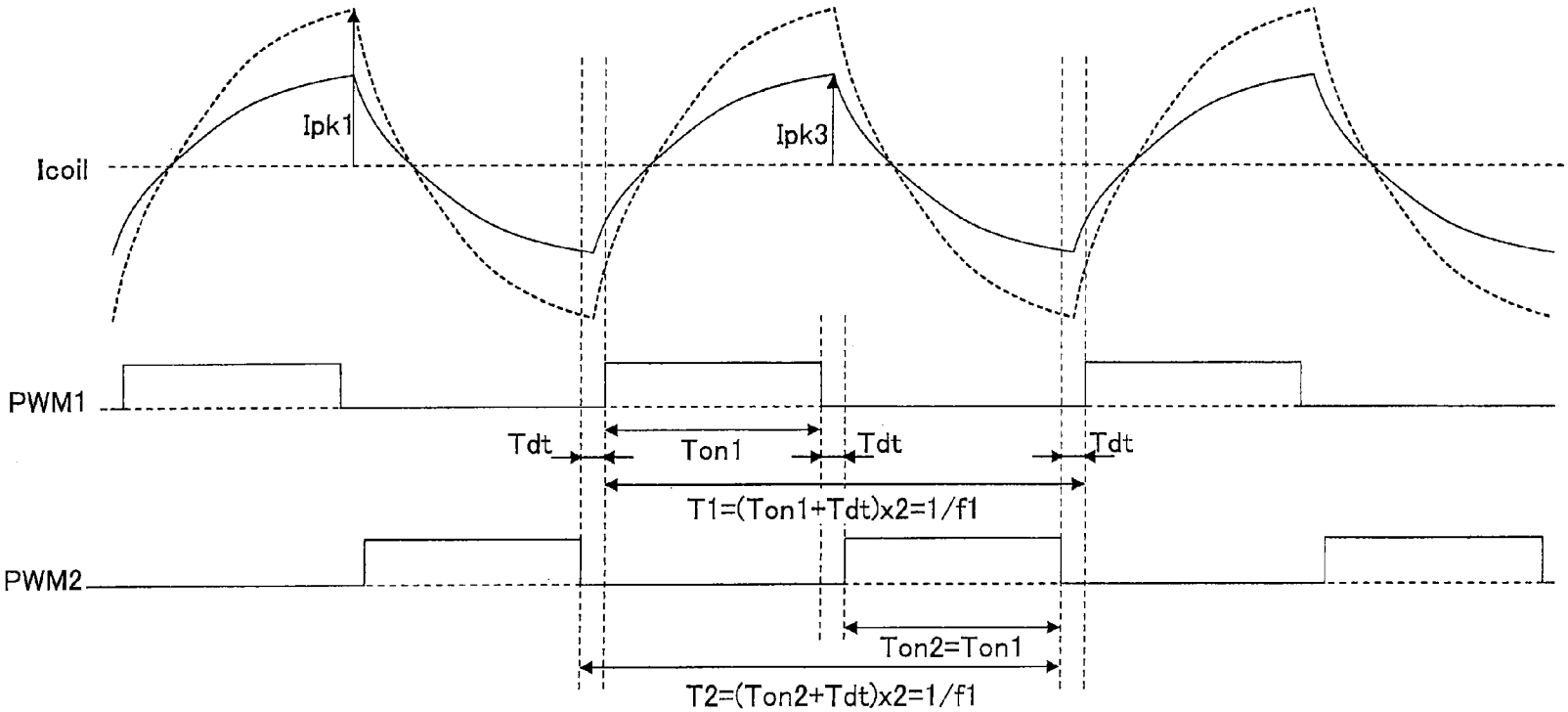
FIG. 14 is a diagram showing the waveforms of the coil current and the PWM signals when the drive frequencies of two adjacent coils are in agreement and the coil voltages supplied to the coils are controlled by the voltage control circuits.

Next, a fixing device according to a second embodiment will be described with reference to FIGS. 13 and 14. The configuration of coil drivers in the fixing device of the second embodiment differs from the configuration of the coil drivers in the fixing device of the first embodiment. In FIGS. 13 and 14, the elements in the second embodiment which are essentially the same as corresponding elements in the first embodiment are designated by the same reference numerals, and a description thereof will be omitted.

FIG. 13 is a diagram showing the configuration of a fixing device 10A of the second embodiment. As shown in FIG. 13, the fixing device 10A of this embodiment includes coil drivers 210A, 220A and 230A.

In the fixing device 10A of this embodiment, the resonance capacitors 212, 222 and 232 are connected in series with the "n" coils, and "nx2" switching elements 214*a*, 214*b*, 224*a*, 224*b*, 234*a* and 234*b* are connected with the "n" coils, respectively.

In the following, the configuration of the coil driver 210A of this embodiment will be described. Other coil drivers 220A and 230A in the fixing device 10A of this embodiment have the same configuration as the configuration of the coil driver 210A, and a description thereof will be omitted.

In the coil driver 210A of this embodiment, one end of the coil 213 is connected with one end of the resonance capacitor 212, and the other end of the resonance capacitor 212 is grounded. The other end of the coil 213 is connected to a junction between one end of the switching element 214*a* and one end of the switching element 214*b*. The other end of the switching element 214*a* is connected with the output of the voltage control circuit 211. The other end of the switching element 214*b* is grounded. A PWM1 signal and a PWM2 signal which are output from a drive circuit 106A are supplied to the gate of the switching element 214*a* and the gate of the switching element 214*b*, respectively.

Similar to the first embodiment, the fixing device 10A of this embodiment includes the "n" voltage control circuits (the first voltage control circuit 211, the k-th voltage control circuit 221 and the n-th voltage control circuit 231) to supply the coil voltage Vcoil[k] ($1<k\leq n$, $n\geq 2$) to the corresponding one of the "n" coils. The rectified voltage Vrect output from the rectifier circuit 104 is supplied to the "n" voltage control circuits, and the control signal Vcont[k] ($1<k\leq n$, $n\geq 2$) output from the CPU 105 is supplied to the corresponding one of the "n" voltage control circuits in order to individually control the coil voltage Vcoil[k] ($1<k\leq n$; $n\geq 2$) supplied to the "n" coils.

The fixing device 10A of this embodiment includes the drive circuit 106A configured to output two PWM signals: the PWM1 signal and the PWM2 signal. The PWM1 signal output from the drive circuit 106A is supplied to each of the gates of the switching elements 214*a*, 224*a* and 234*a*. The PWM2 signal output from the drive circuit 106A is supplied to each of the gates of the switching elements 214*b*, 224*b* and 234*b*. In the fixing device 10A of this embodiment, the drive frequencies of two adjacent coils of the "n" coils are made to be in agreement by controlling the ON/OFF states of the switching elements with the PWM1 signal and the PWM2 signal.

FIG. 14 is a diagram showing the waveforms of the coil current and the PWM signals when the drive frequencies of two adjacent coils are in agreement and the coil voltages supplied to the coils are controlled by the voltage control circuits.

In the example of FIG. 14, the waveforms of the PWM1 signal and the PWM2 signal are illustrated in conjunction with the waveforms of the coil currents Icoil of the two adjacent coils.

In the example of FIG. 14, it is assumed that the coil voltage Vcoil[k] of the k-th coil of the "n" coils is equal to V1 (Vcoil[k]=V1), and the coil voltage Vcoil[k+1] of the (k+1)-th coil of the "n" coils is equal to V3 (Vcoil[k+1]=V3, V1>V3). The peak coil current value Ipk of the coil current Icoil[k] (the waveform of which is indicated by the dotted line in FIG. 14) is set to Ipk1 for the k-th coil, and the peak coil current value Ipk of the coil current Icoil[k+1] (the waveform of which is indicated by the solid line in FIG. 14) is set to Ipk3 for the (k+1)-th coil.

In the example of FIG. 14, when the drive frequency of the switching element connected to the k-th coil is set to fsw1 and the drive frequency of the switching element connected to the (k+1)-th coil is set to fsw2, the drive frequency fsw1 of the k-th coil is represented by the formula fsw1=1/(2×(Ton1+Tdt)), and the drive frequency fsw2 of the (k+1)-th coil is represented by the formula fsw2=1/(2×(Ton2+Tdt)). Because the condition: Ton1=Ton2 is met in the example of FIG. 14, there is no frequency difference between the drive frequencies of the coils. In the absence of the drive frequency difference, no interference noise of the coils is produced.

In the foregoing description, "Tdt" denotes a dead time which is provided to avoid the short-circuiting of the switching elements when the switching of any of the switching elements 234*a* and 234*b*, the switching elements 224*a* and 224*b* and the switching elements 214*a* and 214*b* is performed.

The relationship between the coil voltage Vcoil[k] and the peak coil current value Ipk[k] of this embodiment is essentially the same as that of the first embodiment shown in FIG. 9A. Therefore, similar to the first embodiment, in this embodiment, the peak coil current value Ipk of the coils can be controlled by controlling the coil voltage Vcoil[k]. Namely, the power supplied to the coils can be controlled by controlling the coil voltage Vcoil[k], and the power can be continuously supplied to the coils.

As described in the foregoing, according to the fixing device of the present invention, the power can be continuously supplied to the coils without causing interference noise.

The fixing device according to the present invention is not limited to the specifically disclosed embodiments, and variations and modifications may be made without departing from the scope of the present invention.

The present application is based on and claims the benefit of priority of Japanese Patent Application No. 2012-200911, filed on Sep. 12, 2012, the contents of which are incorporated herein by reference in their entirety.

What is claimed is:

1. A fixing device, comprising:

a plurality of coils which heats a heating object through induction heating;

a plurality of coil drivers that drive the plurality of coils respectively;

a drive circuit that controls ON/OFF states of a plurality of switching elements simultaneously to control the drive of the plurality of coil drivers;

a control unit that controls a voltage supplied to each of the plurality of coils in accordance with the control of the ON/OFF states of the plurality of switching elements by the drive circuit; and a plurality of voltage control circuits that individually change the voltages supplied to the plurality of coils in accordance with the voltage control of the control unit, wherein each of the plurality of coil drivers includes:

a resonance capacitor connected in series with one of the plurality of coils;

a first switching element connected between the one of the plurality of coils and one of the plurality of voltage control circuits; and a second switching element connected between the one of the plurality of coils and the drive circuit, and wherein the drive circuit is configured to control ON/OFF states of the first and second switching elements simultaneously.

2. The fixing device according to claim 1, wherein each of the plurality of coil drivers includes a resonance capacitor connected in parallel with one of the plurality of coils.

3. The fixing device according to claim 1, wherein, when the heating object is heated by the fixing device to fix a toner image formed on a recording sheet to the recording sheet, the control unit is configured to reduce voltages supplied to some of the plurality of voltage control circuits based on image information used to form the toner image on the recording sheet.

4. The fixing device according to claim 3, wherein the control unit is configured to stop some of the plurality of voltage control circuits based on the image information.

5. The fixing device according to claim 1, wherein, when the heating object is heated by the fixing device to fix a toner image formed on a recording sheet to the recording sheet, the control unit is configured to reduce voltages supplied to some of the plurality of voltage control circuits based on a size of the recording sheet.

6. The fixing device according to claim 5, wherein the control unit is configured to stop some of the plurality of voltage control circuits based on the size of the recording sheet.

7. The fixing device according to claim 1, wherein:

each of the plurality of coils includes a plurality of corresponding cores, the plurality of cores each having a center core and side cores.

8. The fixing device according to claim 7, wherein:

each of the cores has arch cores disposed between the center core and a corresponding side core.

9. The fixing device according to claim 7, wherein:

the plurality of coils are around an outside of the corresponding cores.

* * * * *